US005105583A

United States Patent [19]

Hammond et al.

[11] Patent Number: 5,105,583

[45] Date of Patent: Apr. 21, 1992

[54] WORKPIECE DEBURRING METHOD AND APPARATUS

[75] Inventors: Robert E. Hammond, Kalamazoo; Donald L. Schuiteboer, Plainwell, both of Mich.

[73] Assignee: Hammond Machinery Inc., Kalamazoo, Mich.

[21] Appl. No.: 575,130

[22] Filed: Aug. 29, 1990

[51] Int. Cl.[5] ..... B24B 7/00; B24B 9/00

[52] U.S. Cl. ..... 51/120; 51/119; 51/72 R

[58] Field of Search ..... 51/120, 119, 90, 328, 51/72 R

[56] References Cited

U.S. PATENT DOCUMENTS

| | | | |
|---|---|---|---|
| 1,603,950 | 10/1926 | Heichert | 15/211 |
| 1,982,648 | 12/1934 | Drake | 51/120 |
| 2,757,489 | 8/1956 | Touvay et al. | 51/120 |
| 2,948,087 | 8/1960 | Caton | 51/120 |
| 3,421,168 | 1/1969 | Bartel | 15/120 |
| 3,473,181 | 10/1969 | Leonard | 15/77 |
| 4,704,823 | 11/1987 | Steinback | 51/110 |

OTHER PUBLICATIONS

One-page document containing thereon front and side elevational views of deburring apparatus manufactured by Niederberger of Europe.

*Primary Examiner*—Bruce M. Kisliuk
*Assistant Examiner*—John A. Marlott
*Attorney, Agent, or Firm*—Flynn, Thiel, Boutell & Tanis

[57] ABSTRACT

A planetary-type deburring arrangement for removing burrs associated with inside and outside edges of a metal workpiece. The deburring arrangement includes a planetary head arrangement having a carier which rotates about a central axis. The carrier mounts thereon at least three rotatable spindles disposed in a generally circular pattern about the central axis, and each spindle mounts thereon an abrasive disc having an end face constructed of an abrasive media for deburring the workpiece. A first drive arrangement causes rotation of the carrier about the central axis. A second drive arrangement, including a planetary arrangement, is coupled to each of the spindles to effect rotation of each spindle individually about its own axis, with at least one of the spindles being rotated in an opposite direction from the other spindles.

10 Claims, 4 Drawing Sheets

WORKPIECE DEBURRING METHOD AND APPARATUS

FIELD OF THE INVENTION

This invention relates to an improved method and apparatus for efficiently and effectively deburring workpieces.

BACKGROUND OF THE INVENTION

Many metal workpieces, after forming operations such as punching or machining operations, have burrs attached thereto, which burrs extend along outer edges and also around and along edges of openings which may be punched, machined or otherwise formed in the workpiece. At least the majority of these metal burrs must be removed in order to permit utilization of the workpiece, such as incorporation thereof into an apparatus. Numerous techniques including grinding, brushing, blasting and the like have been utilized to accomplish deburring of workpieces. Many of the required techniques are complex and expensive, and often require use of expensive brushing or deburring media. Further, many of the known techniques are only partially successful in removing burrs. In particular, since workpieces typically have numerous edges, such as straight and curved edges, and interior and exterior edges, running in a multitude of directions, effective removal of the burrs from all such edges by means of any singular deburring operation has been substantially impossible. Thus, often multiple or sequential deburring operations, sometimes involving different techniques, have been required. In some instances manual deburring of selected edges is required as a final finishing step.

As one proposal for deburring of metal workpieces, there has been utilized a deburring apparatus employing a large diameter brush having generally axially-oriented bristles so that the brush defines an axial end face which is moved into contact with a workpiece. In this apparatus, the brush is rotated generally about its axis, and simultaneously the workpiece is traversed under the brush, whereby contact between the workpiece and the end face of the brush is utilized to effect deburring. With this arrangement, however, the deburring is basically bi-directional since the face of the brush on the trailing side (as viewed in the direction of movement of the workpiece relative to the brush) generally moves sidewardly in one direction, and the face of the brush on the leading side moves in the opposite direction, so that selected central areas of the workpiece are brushed primarily in a sideward back-and-forth direction. Similarly, those areas of the workpiece which are located more closely adjacent the longitudinal edges of the workpiece primarily receive only uni-directional deburring, either in the direction of movement of the workpiece on one side thereof, or in the opposite direction on the other side thereof, depending upon the direction of brush rotation. Further, with this arrangement, the width of the workpiece should normally be maintained no greater than about one-half the overall brush diameter so as to ensure more intimate contact and maximum movement of the bristles relative to the workpiece. If the workpiece is of significantly greater width relative to the brush diameter, then the deburring efficiency adjacent opposite sides of the workpiece rapidly deteriorates.

In an attempt to improve upon the deburring efficiency of apparatus using contact between the workpiece and an axial end face of a deburring brush, one known deburring arrangement employs a plurality (specifically three) of face-type deburring brushes of smaller diameter, which brushes are mounted in angularly spaced relationship in a circular pattern and are carried by a carrier which is rotatable about a central axis, with the carrier and brushes being provided with a suitable drive so that the brushes rotate individually about their axes while the carrier also rotates about its axis so as to create a planetary-type motion. In this known arrangement, all of the individual brushes are individually rotated in the same direction by the planetary-type drive. While this arrangement provides an improved deburring operation since the individual planetary-type movement of each brush is more effective in removing burrs from edges of different direction or orientation, nevertheless even this arrangement provides less than optimum deburring of some workpieces since each of the planetary brushes still undergoes the same planetating movement.

Accordingly, it is an object of the present invention to provide a deburring method and apparatus which improves upon the known methods and apparatus as described above.

More specifically, the present invention relates to an improved method and apparatus for deburring which employs a plurality of individual deburring discs such as brushes disposed in a circular pattern and individually rotated in a planetary manner similar to the abovedescribed prior arrangement. In this improved method and apparatus, however, at least one of the deburring discs is individually rotated in a direction which is contrary to the rotational direction of the other discs, with all of the discs being subject to a planetary movement, whereby the overall movement created by the deburring head assembly is of a more complex nature due to the reverse rotations of different ones of the deburring discs. The planetary deburring arrangment of this invention thus provides for movement of the deburring brushes relative to a workpiece in a true multidirectional sense, namely in substantially all directions relative to the face of the workpiece which contacts the end face of the deburring discs, so as to thereby permit highly effective and efficient removal of burrs from substantially all types, shapes and orientations of workpiece edges.

Other objects and purposes of the method and apparatus according to the present invention will be apparent upon reading the following specification and inspecting the accompanying drawings.

Figure 1:
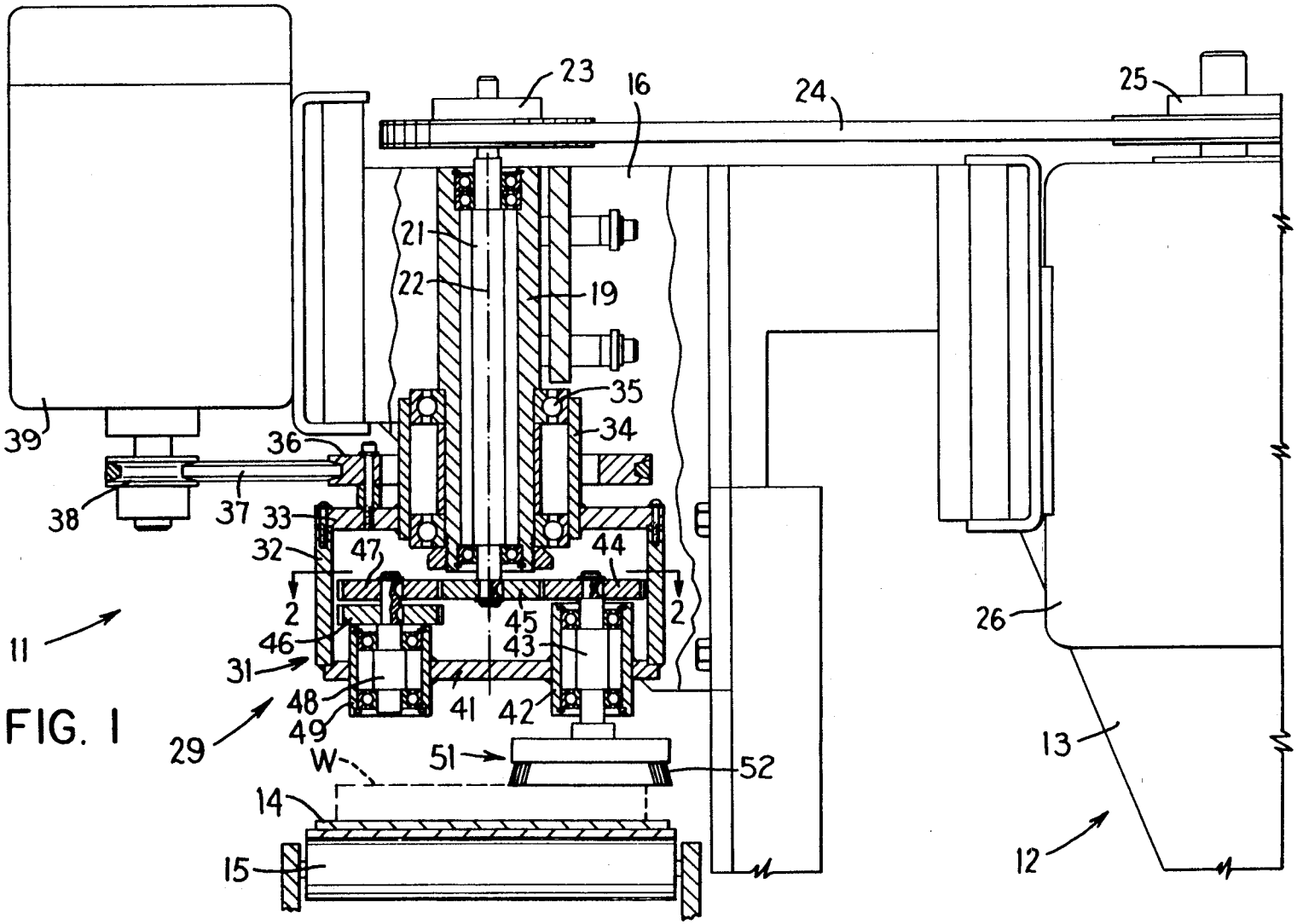
FIG. 1 is a fragmentary elevational view, partially in cross section taken substantially along line 1—1 of FIG. 2, and showing a preferred embodiment of the planetary deburring apparatus of the present invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the apparatus and designated parts thereof. Said terminology will include the words specifically mentioned, derivatives thereof, and words of similar import.

DETAILED DESCRIPTION

Figure 2:
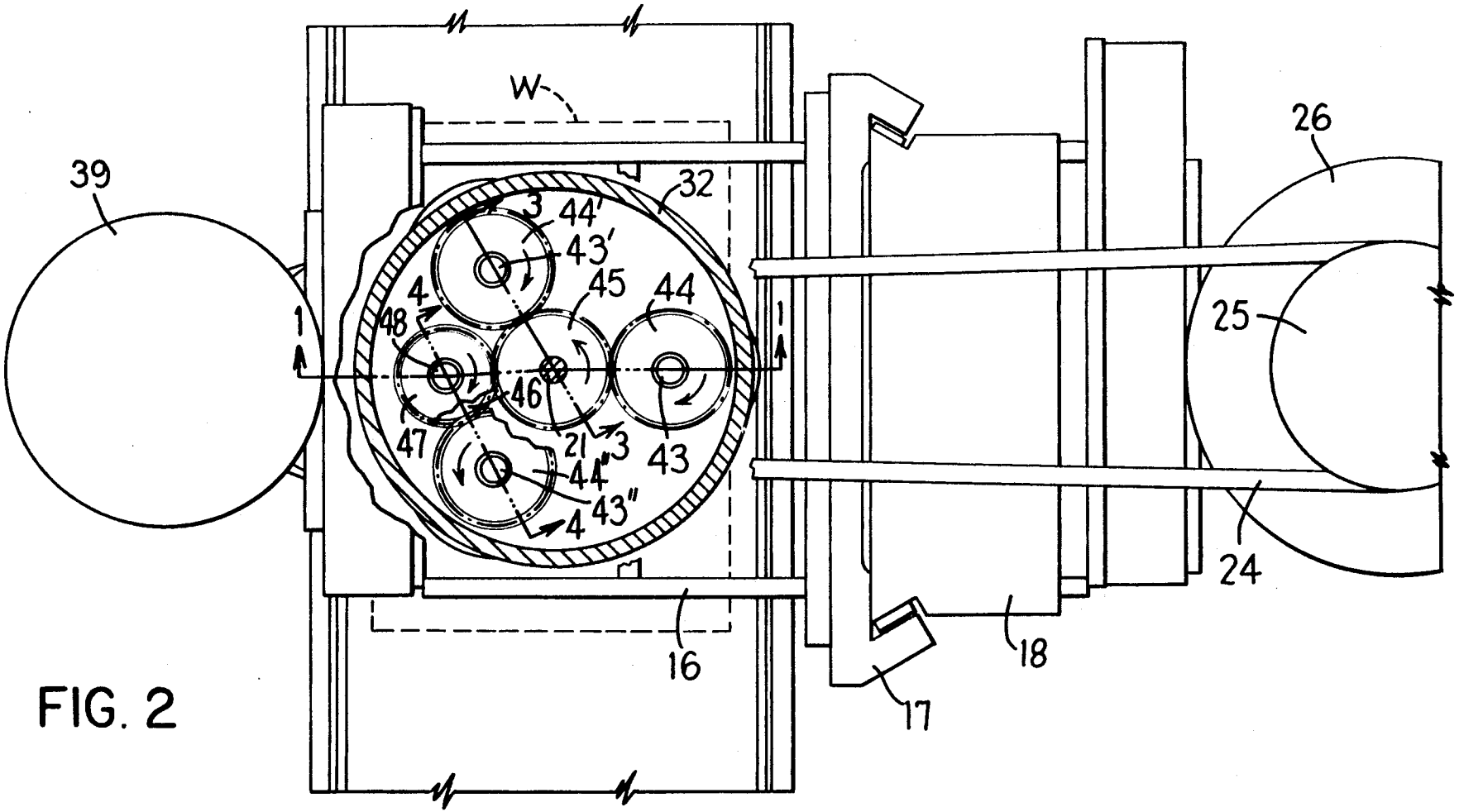
FIG. 2 is a top view, partially in cross section taken substantially along line 2—2 in FIG. 1, of the arrangement shown by FIG. 1.

Referring to FIGS. 1 and 2, there is illustrated a preferred embodiment of a planetary deburring assembly 11 according to the present invention, which assembly 11 is associated with a finishing machine 12 having a housing or frame 13. The machine 12 includes a conventional workpiece support 14 which is movable horizontally and is adapted to support a conventional workpiece W on an upper surface thereof. The workpiece support 14 may comprise a conventional table which is horizontally linearly reciprocal or, in the illustrated embodiment, comprises an endless belt supported on rollers 15, which belt is driven in a conventional manner and has the upper reach thereof disposed for supporting workpieces thereon. This overall construction is conventional and hence is not described in detail.

The planetary deburring assembly 11 includes a support frame 16 which is adapted to be movably supported on the machine frame 13 for disposition above the movable workpiece support 14. For this purpose, the support frame 16 includes a vertically elongate slide or guide way 17 which is vertically slidably engaged with a cooperating guide way 18 secured to the frame 13 so as to enable the entire deburring assembly 11 to be selectively vertically displaced. This is accomplished by a conventional vertical drive (not shown), such as a motor-driven screw spindle drivingly cooperating between the machine frame 13 and the support frame 16.

The support frame 16 of the deburring assembly mounts a hollow and vertically elongate support tube 19 which rotatably supports therein, through conventional anti-friction bearings, a vertically elongate drive shaft or spindle 21, the latter being rotatable about its vertical axis 22. This drive spindle 21 has its upper end projecting outwardly of the support tube 19 and provided with a driven pulley 23 secured thereto, the latter being engaged with a drive belt 24 which in turn is driven by a drive pulley 25. This latter pulley is secured to the drive shaft of a conventional drive motor 26, such as an electric motor.

The lower end of the drive spindle 21 is drivingly coupled to a planetary deburring head 29, which head 29 is coaxially aligned with and rotatably supported on and adjacent the lower end of the support tube 19 for rotation about the central vertical axis 22.

The planetary deburring head 29 includes a substantially closed drum-like carrier 31 formed by a generally cylindrical support sleeve 32 which is of a diameter substantially larger than the support tube 19 and which coaxially projects downwardly from the lower end of the tube 19. This support sleeve 32 is closed at its upper end by a horizontal top wall 33. This top wall 33 is fixedly secured to the lower end of a support tube 34 which is disposed in concentric and surrounding relationship to the support tube 19 solely in the vicinity of the lower end of the tube 19. The support tube 34 is rotatably supported on tube 19 through conventional anti-friction bearings 35.

The carrier 31 is rotated about the central vertical axis 22 by means of a driven pulley 36 which externally surrounds the support tube 34 and is non-rotatably coupled to the carrier 31, such as by being directly axially secured to the top plate 33. This driven pulley 36 is engaged with a drive belt 37, the latter being driven by a drive pulley 38 which is secured to the lower end of a motor shaft associated with a conventional drive motor 39, the latter typically being an electric motor.

The carrier 31 also has a horizontal bottom wall 41 which extends across the lower end of the support sleeve 32 and cooperates with the top wall 33 so as to effectively define a closed cylindrical chamber within the carrier 31. The bottom wall 41 mounts thereon a series of three support tubes 42, 42' and 42'', which tubes are fixed to and project axially through the bottom wall 41. These support tubes are disposed on a circular path generated about the central axis 22, with central vertical axes of the support tubes being uniformly angularly spaced apart at 120° intervals in the illustrated and preferred embodiment. Each support tube 42, 42', 42'' respectively rotatably supports therein a drive spindle 43, 43', 43'' for a tool, specifically a deburring disc. Each of the drive spindles 43,43', 43'' is rotatably supported by conventional anti-friction bearings, and each is rotatable about its longitudinal axis which extends vertically in parallel but radially spaced relation from the central vertical axis 22. The rotational axes of the spindles 43, 43', 43'' are all spaced radially the same distance from the central vertical axis 22, and are spaced circumferentially therearound at uniform angular intervals.

The upper end of the first drive spindle 43 projects upwardly beyond the respective support tube 42 into the interior of the drum-like carrier 31 and has a planet gear 44 non-rotatably secured thereto, which planet gear 44 is disposed in direct meshing engagement with a sun gear 45. This latter gear 45 is non-rotatably secured to the lower end of the drive spindle 21 in close proximity to the lower end of the support tube 19.

Figure 3:
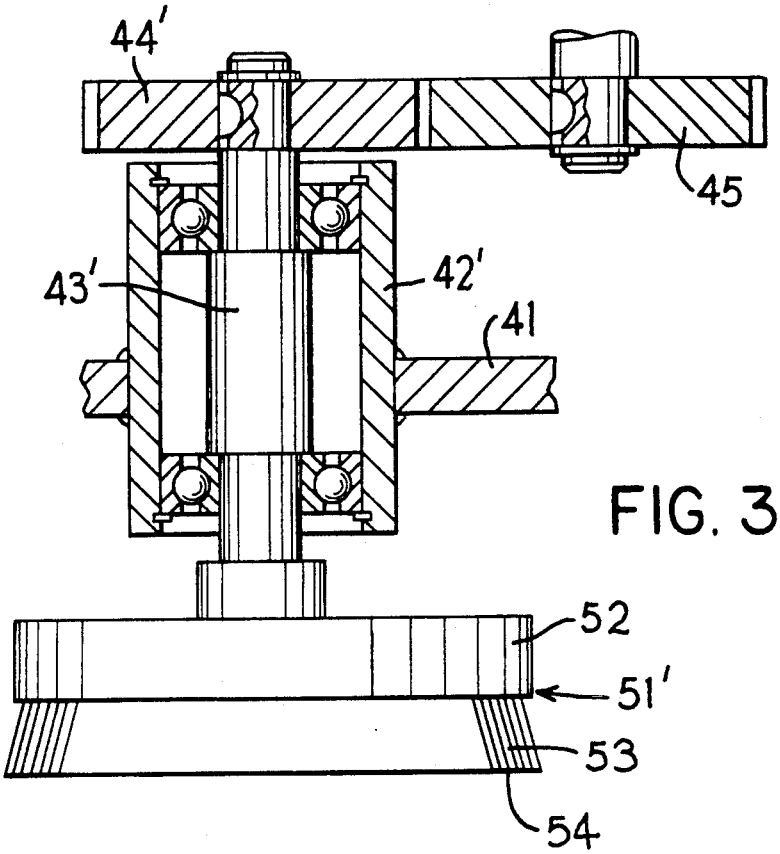
FIG. 3 is an enlarged, fragmentary sectional view taken substantially along line 3—3 in FIG. 2.

The second drive spindle 43', as shown in FIG. 3, also has the upper end thereof projecting outwardly above the respective support tube 42' and is provided with a planet gear 44' non-rotatably fixed thereto, which planet gear is also disposed in direct meshing engagement with the sun gear 45. Since the planet gears 44 and 44' both directly mesh with the sun gear 45, the spindles 43 and 43' hence each rotate in the same direction. Further, in the illustrated embodiment, the planet gears 44 and 44' have identical diameters and teeth arrangements, and thus the spindles 43 and 43' rotate at the same rotational speeds, although it will be appreciated that the gearing could be suitably changed if desired so as to permit the spindles 43 and 43' to rotate at different speeds but in the same rotational direction.

Figure 4:
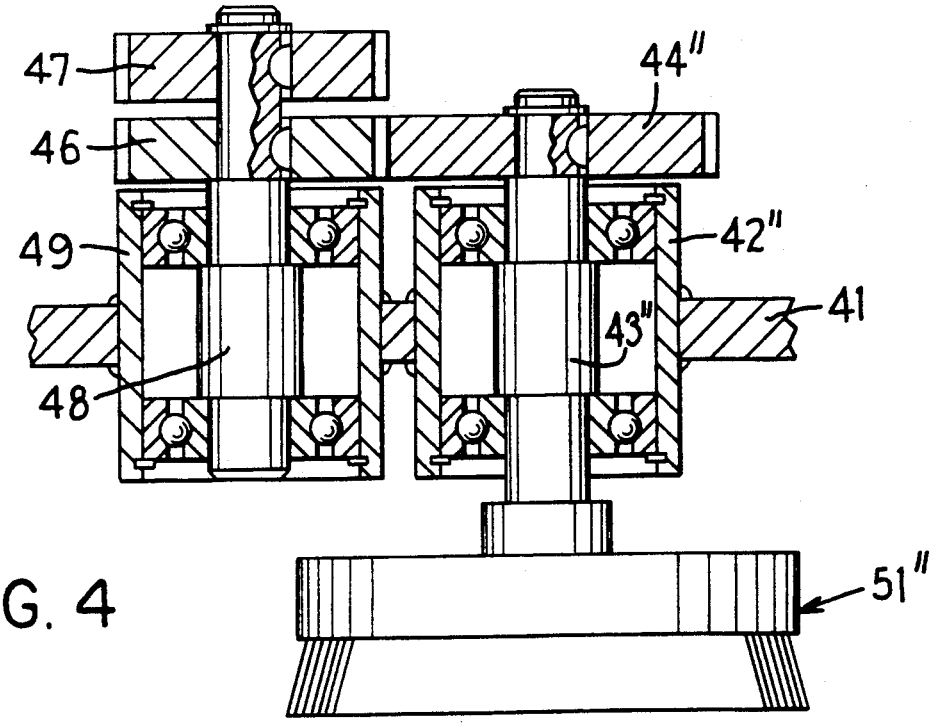
FIG. 4 is an enlarged, fragmentary sectional view taken substantially along line 4—4 in FIG. 2.

Considering now the third spindle 43'', and referring specifically to FIG. 4, the upper end of spindle 43'' projects upwardly beyond the upper end of support tube 42'' and has a planet gear 44'' non-rotatably secured thereto. This planet gear 44'', however, does not directly mesh with the sun gear 45. Rather, planet gear 44'' and sun gear 45 are drivingly interconnected through an intermediate planet gearing arrangement which includes an intermediate planet gear 46 which is in direct meshing engagement with the planet gear 44'', and a further intermediate planet gear 47 which is in direct meshing engagement with the sun gear 45. These intermediate planet gears 46 and 47 are coaxially aligned and are each non-rotatably secured to an upper end of an intermediate spindle 48. The spindle 48 is rotatable about a vertical axis and is rotatably supported, through conventional anti-friction bearings, within an intermediate support tube 49 which is fixed to and projects axially through the bottom wall 41. This intermediate support tube 49 and its associated spindle 48 is spaced radially from the central vertical axis 22 so as to be disposed generally in the angular extent between two of the other support tubes, namely between the support tubes 42' and 42'', as illustrated by FIG. 2.

Due to the presence of the intermediate planet gears 46 and 47 creating an intermediate engagement between the gears 45 and 44'', the third spindle 43'' is hence rotatably driven in the opposite direction from that of the other spindles 43, 43'.

The tool spindles 43, 43', 43'' have the lower ends thereof projecting downwardly beyond the bottom wall 41 so as to permit a deburring tool 51, 51', 51'', respectively, to be removably attached thereto for rotation with the respective tool spindle. The tools 51, 51', 51'' comprise deburring discs which are preferably substantially identical. Each deburring disc includes a base part 52 which permits securement to the projecting end of the respective spindle, and which has secured thereto an annular deburring media 53 defining thereon an axially directed end face 54 disposed for contact with a workpiece. The deburring media 53, in the illustrated embodiment, comprise a plurality of bristles which project axially downwardly from the base part 52 so that the axial end face 54 is defined generally by the free ends of the bristles. The bristles preferably have abrasive characteristics, and for example may comprise nylon bristles which are impregnated with abrasive particles. In the illustrated embodiment, the deburring discs preferably comprise BRUSHLON brushes or discs as sold by 3M Company. Other abrasive media could also be suitable, including SCOTCHBRITE discs as sold by 3M Company.

The operation of the planetary deburring assembly 11 of the present invention will now be briefly described.

The assembly 11 is vertically displaced downwardly so that the end faces 54 of the deburring discs contact and exert a slight pressure against the upper surface of the workpiece W. In fact, the workpiece W will cause a slight upward resilient compression of the abrasive deburring media 53. Further, the workpiece is slowly linearly moved under the planetary deburring head 29 by horizontal movement of the workpiece support 14, such as indicated by arrow 59 in FIG. 5. The workpiece W will have numerous edges which are to be deburred, including outer edges such as side edges 56 and front and rear edges 57, together with inner edges which surround openings or recesses 58 formed in the workpiece, which openings or recesses 58 may have a wide variety of different shapes.

During the traversing movement of the workpiece W beneath the planetary deburring head 29, the deburring head 29 is rotated so that the individual deburring discs 51 move in a planetary type fashion. More specifically, motor 26 is energized to drive spindle 22 at a relatively high rotational speed, and the sun gear 45 thereon in turn directly drives the planet gears 44 and 44' and indirectly drives the planet gear 44'' so that all of the drive spindles 43, 43' and 43'' are rotated about their individual axes at rather high rotational speeds, with the spindle 43'' and its deburring disc 51'' being rotated in the opposite rotational direction from that of the other discs 51 and 51'.

Simultaneous with the rotation of the deburring discs about their individual rotational axes, the drive motor 39 also rotatably drives the carrier 31 at a relatively slow rotational rate about the central axis 22, whereby the spindles 43, 43', 43'' all planetate about the central axis 22 simultaneous with the high speed rotation of the spindles about their own individual axes.

Thus, the planetary rotational movement of the deburring discs 51, 51', 51'' hence cause the discs to effectively move through an area encompassed by the dotted-line circle 61, this being the maximum area covered by the abrasive media. However, the workpiece W will, as illustrated by FIG. 5, typically have a width somewhat less than the diameter of this maximum circular contact area 61 since the outer side portions of this area 61 will not be subjected to as thorough abrasive contact and, more significantly, by making the workpiece W somewhat narrower than the maximum diameter of the contact area 61, the abrasive media will more effectively overlap and permit effective removal of burrs from the side edges 56 of the workpiece.

Figure 5:
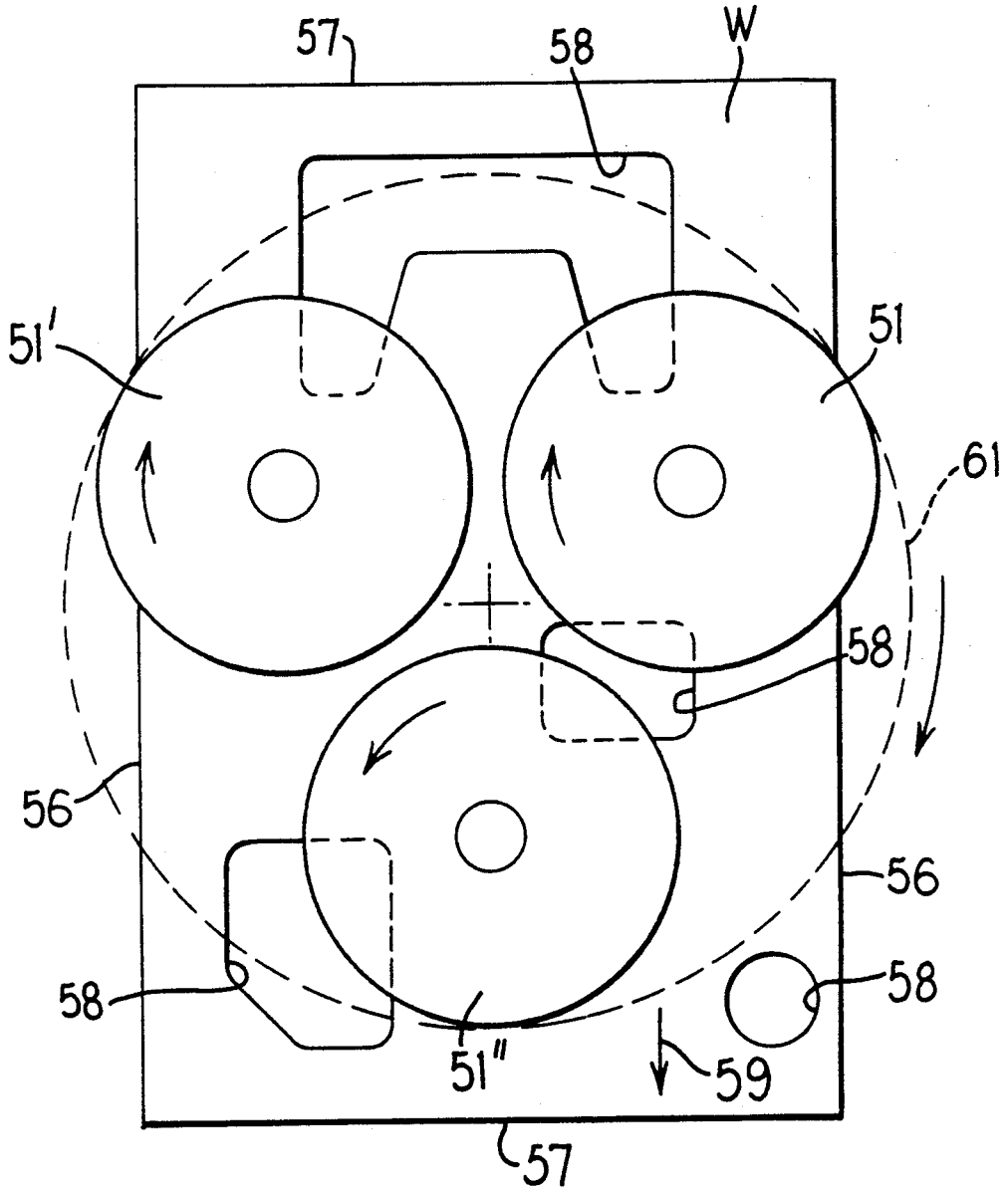
FIG. 5 is a plan view diagrammatically illustrating the cooperation between the planetary deburring head and a sample workpiece.

Hence, as the workpiece W traverses horizontally under the rotating deburring head 29, which traverse of the workpiece is downward in FIG. 5, the overall deburring head rotates generally in a clockwise direction in the illustrated embodiment so that all of the discs 51, 51', 51'' planetate in a clockwise circular pattern. Simultaneously therewith, the discs 51 and 51' individually rotate about their respective axes in a clockwise direction, whereas the other brush 51'' rotates in a counterclockwise direction about its individual axis. This thus results in the abrasive media 53 as provided on the three discs or brushes, as it contacts the upper surface of the traversing workpiece W, cooperating so as to provide multi-directional contact between the abrasive media and the workpiece so as to effectively remove burrs from all of the exterior and interior edges irrespective of the orientation and/or configuration thereof. In fact, with this overall arrangement, effective abrading action occurs between the abrasive media 53 associated with at least one of the deburring brushes and the upper surface of the workpiece in substantially all directions including forwardly, backwardly, rightwardly, leftwardly and various combinations thereof, as viewed relative to the traversing movement of the workpiece.

While the invention as illustrated and described above has the central rotational axis 22 projecting upwardly in perpendicular relationship to the workpiece supporting plane (that is, the upper surface of the support belt 14), nevertheless operational advantages can be achieved by slightly tilting the main rotational axis 22 a few degrees relative to the vertical or perpendicular relationship. For example, by tilting the upper end of axis 22 in the forward direction of movement of the workpiece in FIGS. 1 and 2, then the abrasive discs which contact the downstream or exiting side of the workpiece will be slightly additionally compressed so as to bring greater work pressure to bear, and thus enhance the deburring operation. This slightly tilted relationship, however, at the same time causes the abrasive discs which engage the upstream side of the workpiece to engage the workpiece with slightly less compression, and this will thus facilitate entry of the leading end of the workpiece under the abrasive discs. The forward angle of tilt of this axis 22 relative to the vertical or perpendicular relationship to the path of workpiece movement is preferably in the range of from about 2° to about 5°.

In experimental deburring operations which have been carried out by the assignee of this invention, using a planetary deburring head constructed according to the present invention, it has been observed that deburring workpieces while utilizing the planetary head employing planetary brushes rotating in opposite directions has provided highly desirable results, and in fact surprisingly unexpected results since this invention has been observed to effectively remove even fairly heavy burrs from substantially any type of interior or exterior edge irrespective of its orientation or configuration. In contrast, experimental tests conducted on similar workpieces using a similar planetary deburring head but wherein all of the planet brushes rotate in the same direction were observed to produce results which were not nearly as effective with respect to removal of burrs.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A method for simultaneously deburring inside and outside edges associated with a surface of a metal workpiece, comprising the steps of:

providing a planetary deburring head assembly having a carrier rotatable about a central axis which extends in generally perpendicular relation to the surface of the workpiece, the carrier mounting thereon at least three deburring discs which are axially restrained relative thereto and which each have an axially facing abrasive media of generally annular configuration, each of said discs being rotatable about its axially-extending axis and containing abrasive particles embedded therein, the axially-extending axes of said deburring discs being spaced radially outwardly from said central axis and disposed in angularly spaced relationship therearound relative to one another;

providing each of said abrasive discs of a diameter which is substantially smaller than the width of said workpiece surface, with the width of said workpiece surface being at least slightly smaller than the width of the maximum area traversed by said deburring discs during movement of said head assembly;

moving said deburring head assembly axially so that the axial end faces on all of the deburring discs are moved substantially simultaneously into an operative position for contacting the surface of a workpiece having burrs projecting from inside and outside edges thereof;

rotating said carrier about said central axis at a first rotational rate so as to cause said deburring discs to planetate about said central axis while remaining in contact with the surface on said workpiece;

simultaneously rotating each of said deburring discs about its respective axially-extending axis at a second rotational rate which is significantly greater than said first rotational rate, including rotating at least one of said deburring discs in a clockwise direction about its respective axially-extending axis while simultaneously rotating another of said abrasive discs in a counterclockwise direction about its respective axially-extending axis; and causing relative linear movement between said workpiece and said planetary deburring head assembly in a direction generally along said surface as the rotating and planetating abrasive discs contact said surface.

2. A method according to claim 1, wherein said surface has a width which is between about 60% to about 80% of the width of the maximum area traversed by the deburring discs.

3. In a planetary deburring apparatus for deburring inner and outer edges of a metal workpiece, including a support frame, a planetary head arrangement rotatably supported on said frame for rotational movement about a main axis, said planetary head including a planet carrier which rotates about said main axis and is rotatably driven by a drive means, at least three tool driving spindles rotatably supported on said planet carrier, each said tool spindle being rotatable about its axially-extending central axis, the central axes of said spindles being generally parallel with but spaced radially outwardly from said main axis and being disposed in angularly spaced relationship therearound, each of said tool driving spindles thereon an abrasive disc having abrasive particles embedded therein and disposed for contact with a surface of the workpiece, and said drive means cooperating with said plurality of spindles for causing rotation of each of said spindles about its respective central axis, comprising the improvement wherein said drive means effects rotation of a first said spindle and its respective abrasive disc in a clockwise rotational direction about its central axis, said drive means effecting rotation of a second said spindle and its respective abrasive disc in a counterclockwise direction about its respective central axis, and including means for facilitating simultaneous movement of all of said abrasive discs between first and second positions respectively contacting and spaced from the workpiece surface, said means for facilitating including means for permitting axial movement of said support frame generally parallel to said main axis, said planet carrier being fixed against axial movement relative to said support frame, and said tool driving spindles being fixed against axial movement relative to said planet carrier and being carried with said planet carrier and said support frame for axial movement generally parallel to said main axis.

4. An apparatus according to claim 3, wherein said planetary head assembly mounts only three said abrasive discs thereon.

5. An apparatus according to claim 3, wherein said support frame is axially slidably supported on a stationary housing by an elongate slide and guide way structure which cooperates between said support frame and said stationary housing.

6. An apparatus for deburring inside and outside edges of a workpiece, comprising:

a support frame including a vertically elongate support tube;

a vertically elongate drive shaft rotatably positioned within said support tube and supported for rotation about a vertical central axis, said drive shaft having upper and lower ends which respectively project in cantilevered fashion beyond the respective opposite ends of the support tube;

a planetary head assembly rotatably supported on said support tube adjacent the lower end thereof and projecting coaxially downwardly therefrom;

said planetary head assembly including a substantially closed drum-like carrier which includes an interior chamber and is defined by a generally vertically extending sleeve-like sidewall closed at its opposite ends by upper and lower end walls, said upper end wall being disposed in close proximity to the lower end of said support tube and extending radially outwardly therefrom, said carrier having a support sleeve which is of smaller diameter than said sleeve-like sidewall and which is fixed to said upper end wall and projects upwardly therefrom, said support sleeve being disposed in externally surrounding relationship to and rotatably supported on said support tube adjacent to the lower end thereof;

first drive means drivingly coupled to the upper end of said drive shaft for effecting rotation thereof and second drive means coupled to said carrier for effecting rotation thereof relative to said support tube about said central axis;

at least three tool-mounting drive spindles rotatably supported on said carrier, each of said drive spindles being rotatably supported on and projecting axially through said lower end wall so that the respective drive spindle is rotatable about its respective axial axis, the axial axis of each said spindle extending generally vertically and being spaced radially outwardly from said central axis, the axial axes of said plurality of spindles being angularly spaced from one another so as to define a generally circular pattern which encircles said central axis;

rotation transmitting means disposed within the interior of said carrier and coupled between the lower end of said drive shaft and each of said drive spindles for causing rotation of each of said drive spindles about its respective axial axis, said rotation transmitting means including first transmitting means coupled between said drive shaft and a first said drive spindle for causing rotation of said first drive spindle in a first rotational direction, and second transmitting means coupled between said drive shaft and a second said drive spindle for causing rotation of said second drive spindle in a second rotational direction which is opposite to said first direction; and disc-like abrasive means mounted on a lower end of each said drive spindle nd defining thereon a downwardly facing axial end face for effecting removal of burrs from edges associated with a workpiece, said abrasive means including a carrier material having hard abrasive particles embedded therein for permitting severing of burrs from the workpiece.

7. An apparatus according to claim 6, wherein the carrier material comprises plastic filaments or bristles having hard abrasive particles embedded therein.

8. An apparatus according to claim 6, wherein said rotation transmitting means includes a sun gear which is positioned within said interior chamber and is nonrotatably secured to the lower end of said drive shaft, said first transmitting means including a first planet gear non-rotatably fixed to an upper end of said first drive spindle and disposed in direct meshing engagement with said sun gear, and said second transmitting means including a second planet gear which is non-rotatably fixed to an upper end of said second drive spindle and drivingly interconnected to said sun gear through at least one intermediate gear.

9. An apparatus according to claim 8, wherein said second drive means includes an annular driven member which is non-rotatably secured to said carrier and is positioned above said upper wall in surrounding relationship to said support sleeve.

10. A deburring apparatus, comprising:

a frame;

a workpiece conveyor supported by said frame for moving workpieces through a deburring zone;

a planetary deburring assembly supported on said frame in said deburring zone above said workpiece conveyor for vertical sliding movement with respect toward and away from said workpiece conveyor, said planetary deburring assembly comprising a non-rotatable vertical, elongated tube, a vertical, elongated, rotatable drive shaft inside said tube and supported therein for rotation about a central vertical axis, said drive shaft projecting below the lower end of said tube, a planetary deburring head rotatably mounted on the outside of said tube close to the lower end thereof and supported for rotation with respect to said tube about said central axis, said deburring head comprising an upright hollow carrier which is rotatably mounted on and projects downwardly from the lower end of said tube, at least three, rotatable, annular deburring discs located below the lower end of said carrier and drive means mounted inside said carrier for rotating said deburring discs, said drive means comprising a drive spindle extending vertically upwardly from each of said deburring discs and means supporting said drive spindles for rotation about vertical axes which are parallel with and radially outwardly spaced from said central axis, said deburring discs and drive spindles being disposed in a circular pattern at equal angular spacings from each other around said central axis, at least one intermediate spindle in said carrier between two adjacent drive spindles, said intermediate spindle extending parallel with said drive spindles and having first and second intermediate planet gears mounted thereon for rotation therewith, a planetary gear set disposed in said carrier for rotating said spindles, said planetary gear set comprising a sun gear mounted on the lower end of said drive shaft for rotation therewith about said first vertical axis, each of said drive spindles having a planet drive gear mounted thereon, the planet drive gears on said drive spindles for at least two, but less than all, of said deburring discs being directly drivingly meshed with said sun gear to provide at least two directly driven deburring discs, said first intermediate planet gear being directly drivingly meshed with said sun gear and said second intermediate planet gear being directly drivingly meshed with the drive planet gear on the drive spindle of at least one another, non-directly driven, deburring disc whereby said other deburring disc is rotated in the opposite rotational direction than said directly driven deburring discs, said deburring discs each being comprised of filaments and having abrasive particles embedded therein.

* * * * *

UNITED STATES PATENT AND TRADEMARK OFFICE

CERTIFICATE OF CORRECTION

PATENT NO. : 5 105 583

DATED : April 21, 1992

INVENTOR(S) : Robert E. Hammond et al

It is certified that error appears in the above-identified patent and that said Letters Patent is hereby corrected as shown below:

Column 7, line 35; change "of" to ---on---.

Column 8, line 27; after "spindles" insert ---having mounted---.

Column 9, line 50; change "nd" to ---and---.

Signed and Sealed this

Fourteenth Day of September, 1993

Bruce Lehman

*Attest:*

BRUCE LEHMAN

*Attesting Officer*

*Commissioner of Patents and Trademarks*